United States Patent [19]

Kulow

[11] 4,431,323

[45] Feb. 14, 1984

[54] ENVELOPE FEEDER METHOD AND APPARATUS

[75] Inventor: Howard H. Kulow, Berea, Ohio

[73] Assignee: Kulow Products, Inc., Cleveland, Ohio

[21] Appl. No.: 290,180

[22] Filed: Aug. 5, 1981

[51] Int. Cl.[3] ..... B41J 13/10

[52] U.S. Cl. ..... 400/625; 400/629; 271/2; 271/3.1; 271/4; 271/245; 271/269; 271/271

[58] Field of Search ..... 400/134.3, 624, 625, 400/626, 627, 628, 629; 271/2, 3.1, 4, 6, 7, 10, 12, 16, 18, 21, 23, 34, 35, 109, 110, 198, 226, 227, 245, 246, 258, 265, 269, 271

[56] References Cited

U.S. PATENT DOCUMENTS

| | | | |
|---|---|---|---|
| 881,126 | 3/1908 | Hutches, Jr. | 400/625 |
| 1,135,140 | 4/1915 | Roberts | 400/626 |
| 1,171,354 | 2/1916 | Roberts | 400/626 X |
| 1,900,982 | 3/1933 | Dreyer | 400/629 X |
| 2,135,541 | 11/1938 | Stuart et al. | 400/625 |
| 2,242,268 | 5/1941 | Sherman | 400/629 |
| 2,817,517 | 12/1957 | Wittkuhns et al. | 271/23 |
| 4,067,566 | 1/1978 | Williams | 400/625 X |
| 4,131,273 | 12/1978 | Kufrin et al. | 271/226 X |
| 4,340,314 | 7/1982 | Berger | 400/625 |

OTHER PUBLICATIONS

Feeder-One Brochure on Series 1000-Model 40A Automatic Envelope Feeder.

Daisytek Brochure on Marc 2000 Series Automatic Envelope Feeder.

Datamarc Brochure on Marc 2000 Automatic Envelope Feeder.

*Primary Examiner*—Ernest T. Wright, Jr.

*Attorney, Agent, or Firm*—David A. Burge

[57] ABSTRACT

A method and apparatus are disclosed for sequentially feeding pieces of stationery such as envelopes from a supply hopper to a conventional printer mechanism for printing addresses or the like thereon, and for sequentially transporting printed pieces to a storage hopper. The system of the invention utilizes a dispensing mechanism for feeding one piece of stationery at a time from the supply hopper, a positioning mechanism for receiving a piece of stationery and positioning it along the path of travel of a pair of transport belts, and a transport mechanism for belt-feeding pieces of stationery around a printing platen for printing.

28 Claims, 9 Drawing Figures

ENVELOPE FEEDER METHOD AND APPARATUS

BACKGROUND OF THE INVENTION

1. Field of the Invention

The present invention relates to a system for serially feeding pieces of stationery such as envelopes to a printing station of a conventional printing machine such as a typewriter, and for removing pieces of printed stationery from the printing station.

2. Prior Art

There has long been a need for a reliable system to automatically serially feed pieces of stationery such as envelopes to and from a printing station of a printer such as a typewriter. With the advent of automatic typewriters and other types of programmable printing equipment which can operate without human attendance, the need for a reliable stationary feeder system has been accentuated.

In an effort to satisfy this need, several proposals have been made. One proposal is to utilize continuous-form stationery rather than discrete pieces of stationery, whereby an uninterrupted web of stationery is fed around a platen roll of a printer. This proposal has suffered from several drawbacks including the increased costs of continuous-form stationary, and the form-letter appearance of such stationery which often results in advertising mailings being readily detected and discarded by recipients.

Another proposal has been to provide a feeding unit in the form of an appliance which is positioned adjacent to a platen roll of a printer for serially introducing envelopes to the printer at one side of the platen roll, and for removing printed envelopes from the other side of the platen roll. This proposal lacks a positive-feed transport system for reliably conveying envelopes around the platen roll for precise positioning at a printing station, whereby it is not uncommon for envelopes to misfeed or fail to feed around the platen roll of the printer.

SUMMARY OF THE INVENTION

The present invention overcomes the foregoing and other drawbacks by providing a stationery feeder capable of positively feeding envelopes around a platen of a printer and properly serially positioning envelopes in a printing station.

A feature of the invention lies in the provision of a feeder which mechanically interconnects with a platen roll of a printer, and which is caused to cycle through its sequence of operation in response to rotation of the platen roll. By this arrangement, a programmable printer such as an automatic typewriter can be programmed to initiate the printing of a new address at the exact time when the feeder has presented a new envelope in the printing station, whereby unattended automatic addressing of a large number of envelopes can be reliably effected.

A further feature of the invention lies in the use of three separate feeding mechanisms to effect serial feeding of envelopes from a supply stack to a printing station. A dispensing mechanism supports a supply stack of envelopes and dispenses them one at a time from the bottom of the stack. A positioning mechanism receives envelopes from the dispensing mechanism and positions them one at a time along the path of travel of a pair of transport belts. A transport mechanism includes the transport belts and structure for defining their travel path such that the travel path extends around the printing platen roll. The belts have lugs which engage the trailing edge of an envelope to be fed, and positively feed the envelope along the travel path to and from the printing station.

Still another feature of the invention lies in the provision of a feeder apparatus which can easily be modified for use with a wide variety of conventional printers. Inasmuch as no electrical interconnection need be made between the feeder and an associated printer, the feeder can be used with almost any type of platen-roll-type printer by providing the feeder with a platen roll which fits the printer.

These and other features and a fuller understanding of the present invention may be had by referring to the following detailed description and claims taken in conjunction with the accompanying drawing.

DESCRIPTION OF THE PREFERRED EMBODIMENT

Figure 1:
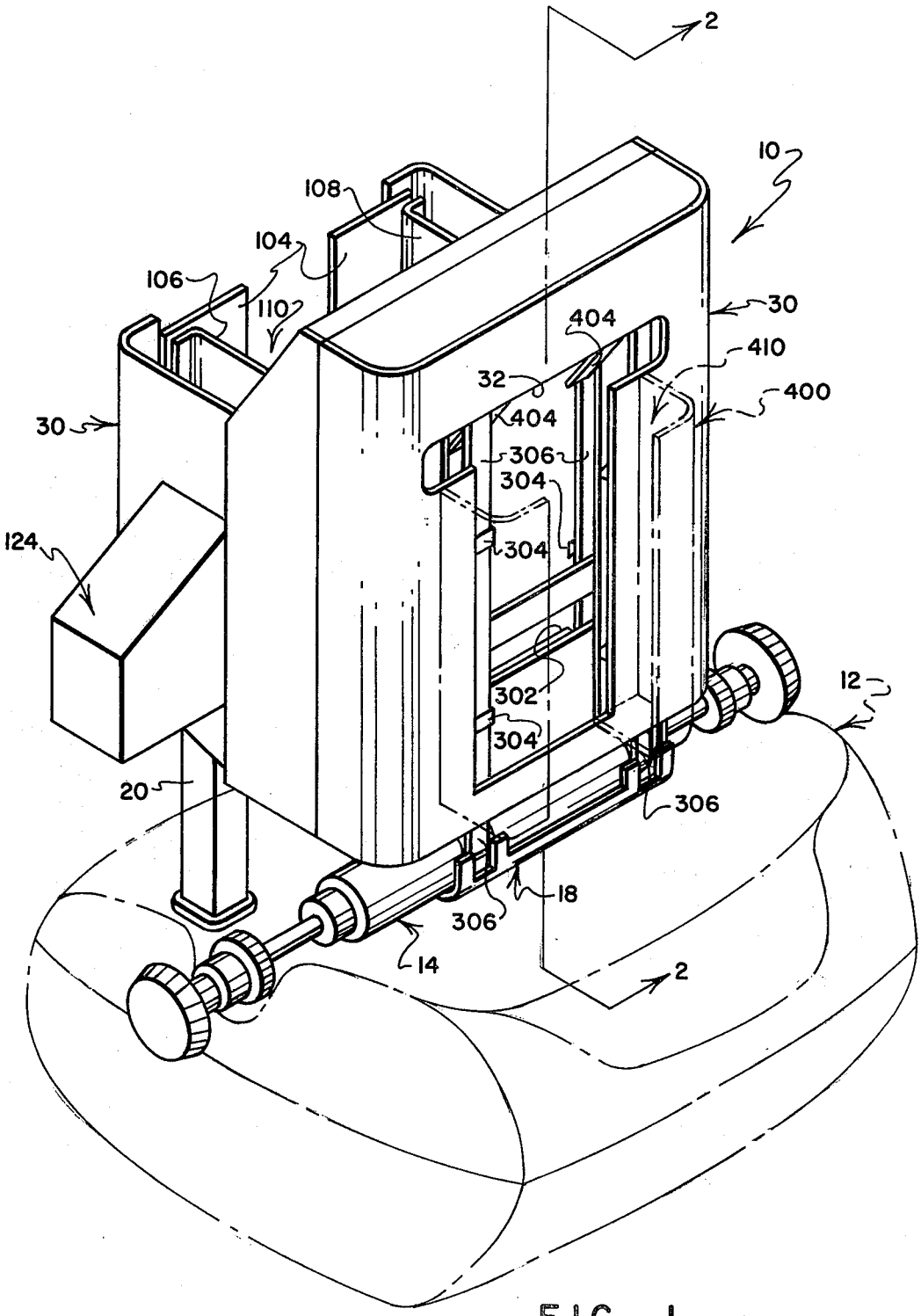
FIG. 1 is a perspective view of an envelope feeder embodying the preferred practice of the present invention, the feeder being positioned adjacent a conventional printer outlined in phantom.

Referring to FIG. 1, a stationary feeder embodying the preferred practice of the present invention is indicated generally by the numeral 10. The feeder 10 is designed to serve a conventional printer 12 of the type having a platen roll 14 adjacent which pieces of stationery such as envelopes 16 are positioned, one at a time, for printing by the printer's imprinting unit (not shown). As will be explained in greater detail, the feeder 10 is linked mechanically with the platen roll 14 such that (1) the platen roll 14 serves to support and position portions of the feeder 10, and (2) rotation of the platen roll 14 serves to cycle the feeder 10 through its sequence of operation.

Figure 2:
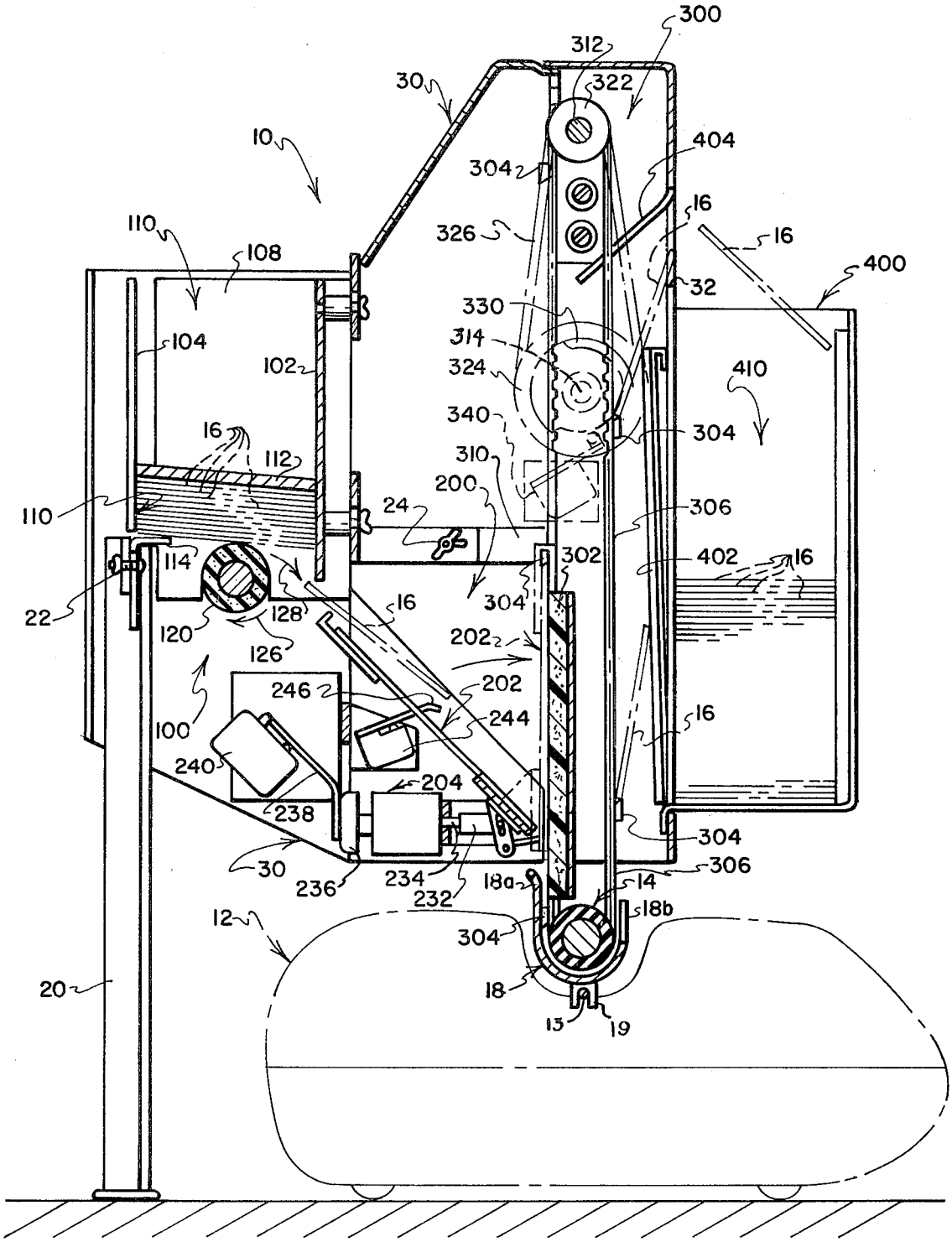
FIG. 2 is a sectional view as seen from a plane indicated by a line 2—2 in FIG. 1.
Figure 3:
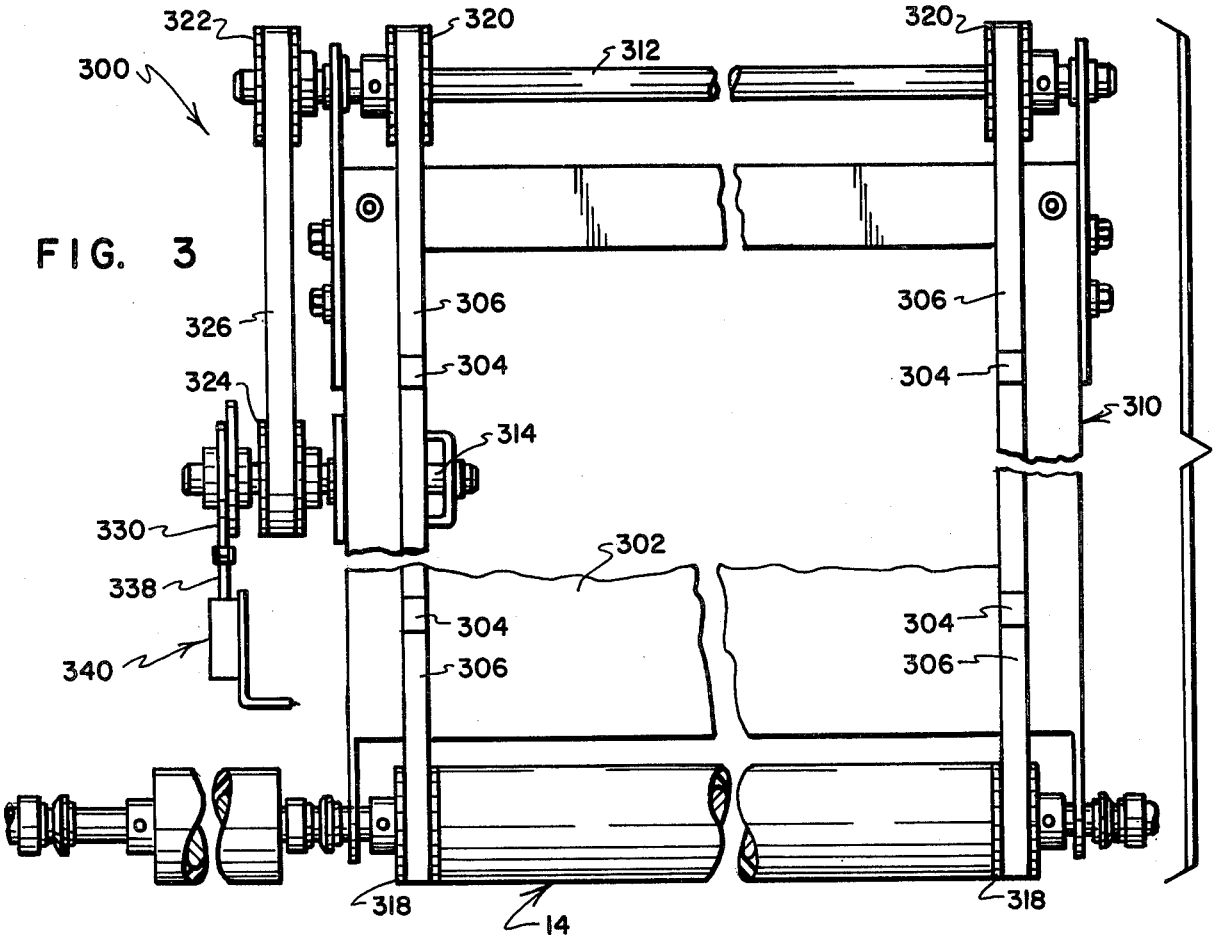
FIG. 3 is a foreshortened front elevational view of a transport assembly employed in the feeder of FIG. 1.

In order to adapt the printer 12 to receive the feeder 10, only two modifications are required. Referring to FIGS. 1 and 2, the printer's conventional U-shaped paper guide (not shown) which ordinarily underlies the platen roll 14 is removed and is replaced with a paper guide 18 having longer upstanding guide surfaces 18*a*, 18*b*. Of conventional structure, suitable bifurcated brackets 19 (FIG. 2) may be provided on the paper guide 18 which in turn may be received in supported relation upon a rod 13 mounted on the printer 12 parallel to the platen roll 14. Referring to FIGS. 1 and 3, the printer's conventional platen roll (not shown) is replaced with a modified platen roll 14 which forms a part of the feeder 10.

While the feeder 10 is disclosed in the form of an apparatus for feeding envelopes 16 to and from the printer 12, it will be understood that the system of the present invention can be embodied in other forms configured to feed items of stationery other than envelopes 16.

The feeder 10 includes an upstanding housing 30 which encloses three separate feeding assemblies. Referring to FIG. 2, a dispensing mechanism is indicated generally by the numeral 100, a positioning mechanism is indicated generally by the numeral 200, and a transport mechanism is indicated generally by the numeral 300.

As will be explained in greater detail, the feeder 10 operates by dispensing envelopes 16, one at a time, from a supply chamber 110 of the dispensing mechanism 100. A feed roll 120 within the dispensing mechanism 100 is rotated to dispense an envelope 16 downwardly and forwardly onto a platform 202 defined by the positioning mechanism 200. The platform 202 pivots forwardly as shown in phantom in FIG. 4 to a delivery position shown in phantom in FIG. 2 to position the envelope 16 against a resilient panel 302 on the rear face of the transport mechanism 300, whereafter lugs 304 carried on a pair of transport belts 306 engage the envelope 16 and feed the envelope 16 downwardly. As the envelope 16 travels downwardly, the paper guide 18 cooperates with the belts 306 to guide the envelope 16 around the platen roll 14. The belts 306 position the envelope 16 quite precisely at the printing station of the printer 12 for addressing by the printer 12. After the envelope 16 has been addressed by the printer 12, the belts 306 convey the envelope 16 upwardly to a location where it is discharged through an opening 32 formed in the front of the housing 30, whereafter the envelope 16 drops into a storage rack or receiving hopper 400.

The feeder 10 is supported atop the printer 12 by a pair of legs 20 which depend from the housing 30 at a location behind the printer 12, and by the platen roll 14 which forms a part of the transport mechanism 300. Referring to FIG. 2, the legs 20 are adjustably connected to the housing 30 by threaded fasteners, one being indicated by the numeral 22. The transport assembly 300 has a frame 310 which is adjustably connected to the housing 30 by a threaded fastener 24.

While the housing 30 is depicted as comprising an assembly of sheet metal members, it will be understood that a protective enclosure of molded plastics materials or the like can be substituted to provide an equally rigid structure of good appearance. Inasmuch as the configuration of the protective housing 30 is not critical to proper functioning of the operational components of the feeder 10, the configuration of the housing 30 need not be described in detail.

Referring to FIGS. 1 and 2, the dispensing mechanism 100 includes upstanding wall members 102, 104, 106, 108 which define the front, rear, and opposite sides of the upwardly opening supply chamber 110. Returning to FIG. 2, envelopes 16 to be fed are inserted into the chamber 110 to form a stack. A backing plate 112 is inserted atop the stack of envelopes 16 to assist in maintaining the stack of envelopes 16 in an orderly arrangement. A narrow foot-like projection 114 extends into the supply chamber 110 to support a central rear edge portion of the lowermost envelope 16. The feed roll 120 extends across the chamber 110 from side to side and engages the bottom face of the lowermost envelope 16 in the chamber 110.

A feed motor, indicated generally by the numeral 124 in FIG. 1, is provided for rotating the feed roll 120 in a direction which is indicated by an arrow 126 in FIG. 2. When the feed roll 120 turns, the lowermost envelope 16 in the stack is caused to feed downwardly and forwardly onto the platform 202 of the positioning assembly 200, as is indicated by an arrow 128 in FIG. 2.

The walls 102, 104, 106, 108 may be arranged to be adjustably positioned with respect to the housing 30 to provide a chamber 110 of variable size for receiving pieces of stationery of various sizes. However, in the feeder embodiment shown in the drawing, the walls 102, 104, 106, 108 are mounted in a fixed manner and define a chamber 110 which will accommodate envelopes 16 of a predetermined size.

Referring to FIGS. 2, 4 and 7–9, the positioning assembly 200 includes the platform 202 and an electrically operated solenoid 204 for pivoting the platform 202 between a receiving position and a delivery position. The receiving position is shown in solid lines in FIGS. 2 and 4, and is depicted schematically in FIG. 7. The delivery position is shown in phantom in FIG. 2, and is depicted schematically in FIG. 9.

Figure 5:
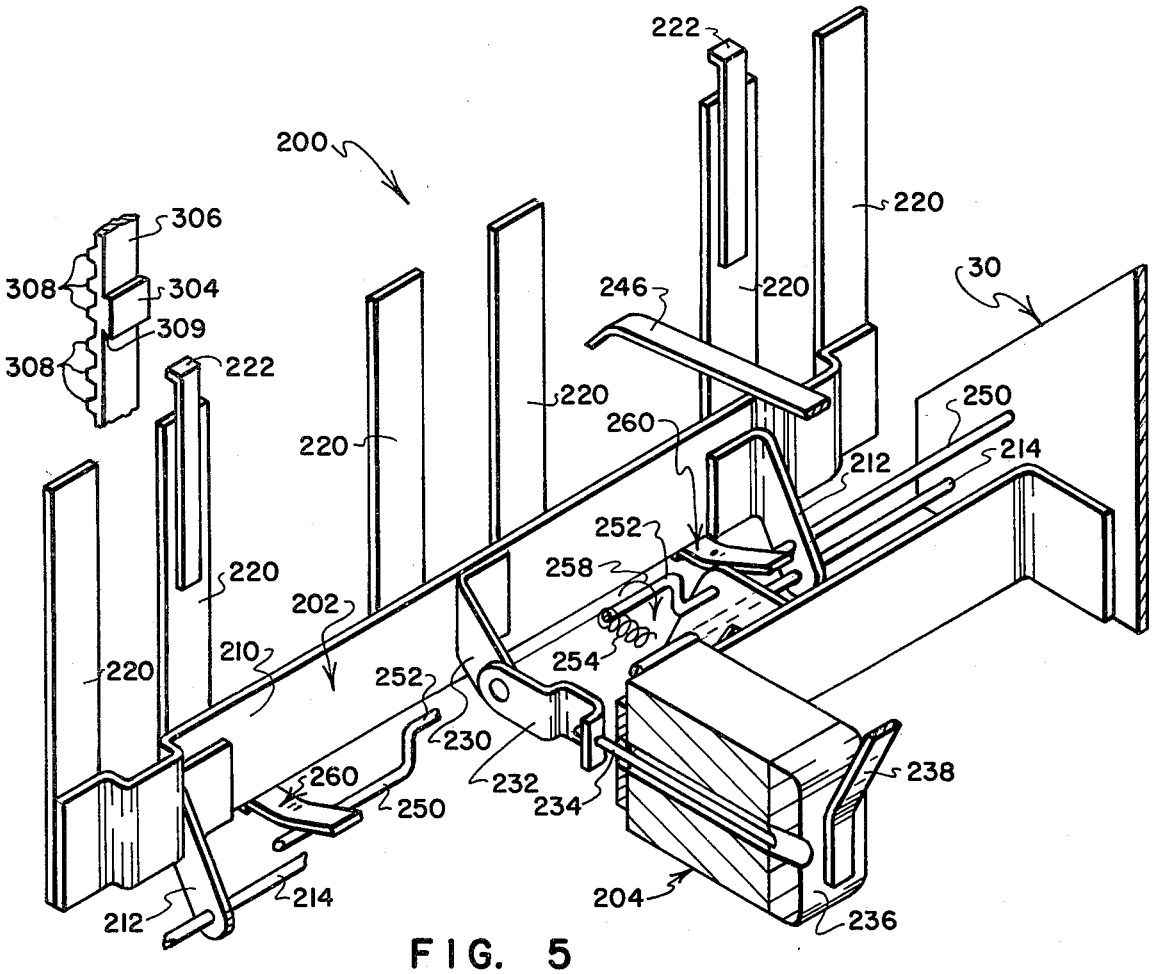
FIG. 5 is a perspective view of the positioning assembly of FIG. 4 with the components in their delivery position.

As is best seen in FIG. 5, the platform 202 has a transversely extending base strip 210, from which two mounting arm 212 depend. The platform 202 is pivotally mounted on the housing 30 by a shaft 214 which extends through aligned holes formed in the arms 212, and has its opposite ends supported by the housing 30. Six finger-like members 220 extend upwardly from the base strip 210 and cooperate with the base strip 210 to define a platform on which an envelope 16 can be received. Two of the fingers 220 have hook-shaped end extensions 222 which assist in keepiig an envelope 16 in a proper delivery position for engagement by the transport belts 306 when the platform 202 has pivoted to its delivery position.

An operating arm 230 extends rearwardly and downwardly from the base strip 210, and is connected pivotally to a link 232. The link 232 connects with an armature 234 of the electrically-operated solenoid 204. When no electricity is supplied to the solenoid 204, the armature 234 is positioned as shown in solid lines FIG. 2, whereby the platform 202 is caused to be positioned in its receiving position. When electricity is supplied to the solenoid 204, the armature 234 is caused to translate to the position shown in FIG. 5 and in phantom in FIG. 2, whereby the platform 202 is caused to be positioned in its delivery position.

The armature 234 has an enlarged head portion 236 which is engaged by an operating lever 238 of a switch 240. When the solenoid 204 is energized to move the platform 202 to its delivery position, the solenoid-operated switch 240 opens to break an electrical circuit, as will be described in conjunction with FIG. 6. When the solenoid 204 is deenergized, the armature head 236 engages the lever 238 and operates the switch 240 to effect circuit closure.

Figure 6:
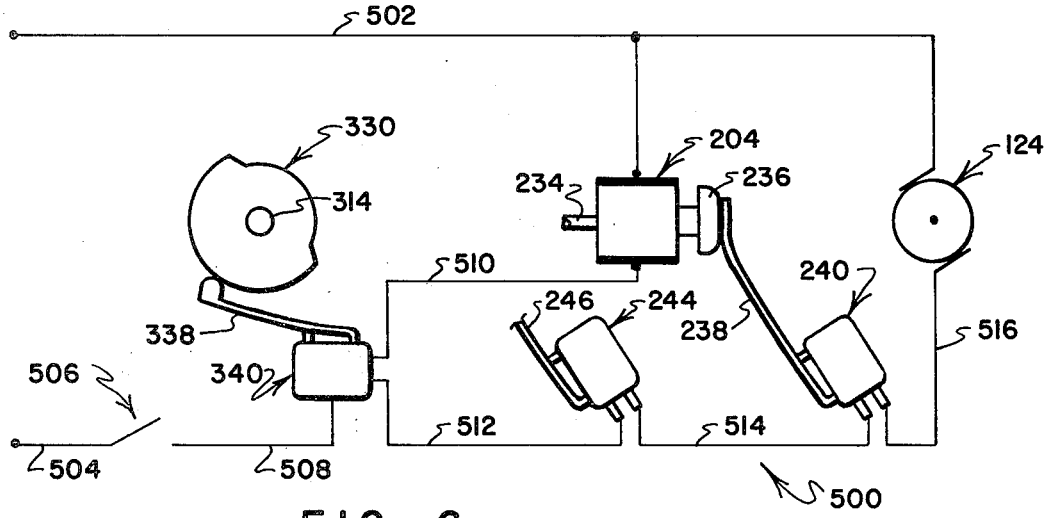
FIG. 6 is a schematic diagram of an electrical circuit employed in the feeder of FIG. 1.
Figure 7:
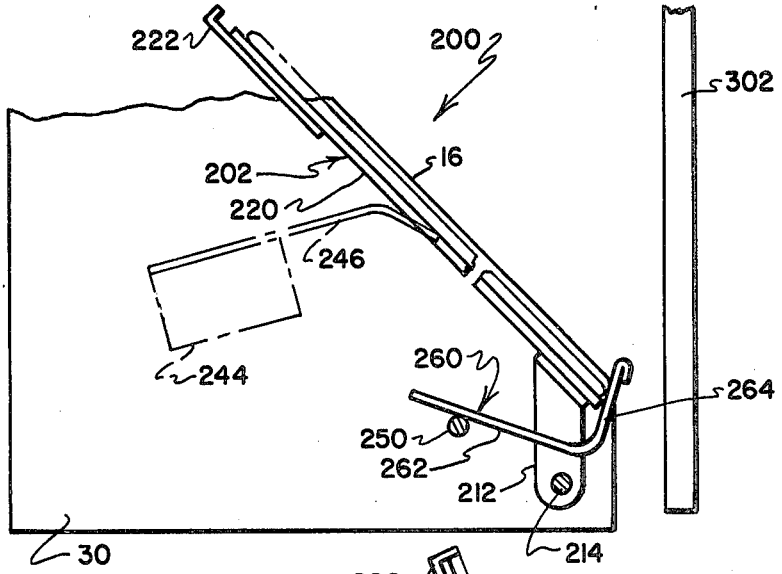
FIG. 7 is a schematic diagram of the positioning mechanism components shown in their receiving position.
Figure 8:
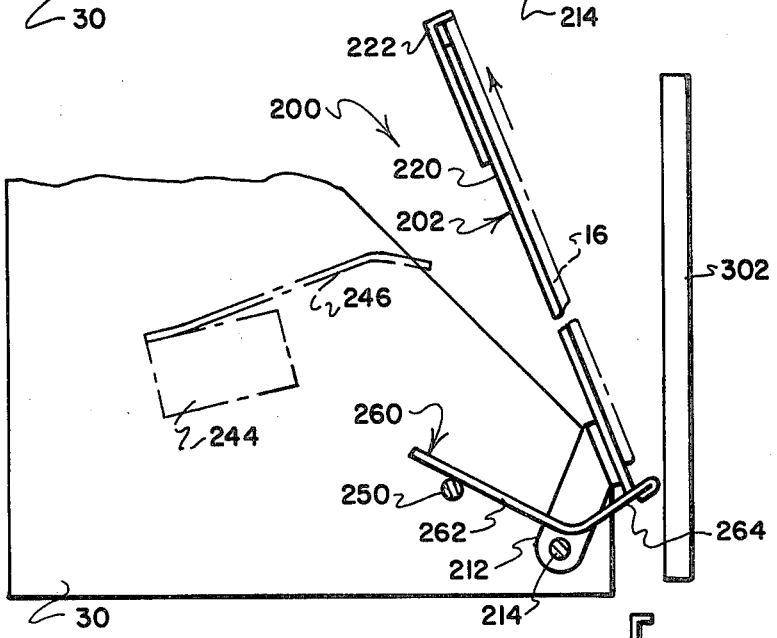
FIG. 8 is a schematic diagram similar to FIG. 7 with the positioning mechanism components shown during movement from their receiving position to their delivery position; and, FIG 9 is a schematic diagram similar to FIGS. 7 and 8 with the positioning mechanism components shown in their delivery position.

Referring to FIGS. 2 and 7–9, a sensing switch 244 is supported on the housing 30 at a location below and behind the platform 202. The sensing switch 244 has an operating lever 246 which extends forwardly to a position where it will be engaged and depressed by an envelope 16 on the platform 202 when the platform 202 is in its receiving position. When the operating lever 246 is depressed, as is shown in FIG. 7, the switch 244 opens to break an electrical circuit, as will be described in conjunction with FIG. 6. When the platform 202 moves forwardly, as is shown in FIG. 8, or when no envelope 16 is on the platform 202, as is shown in FIG. 2, the switch 244 operates to effect circuit closure.

Figure 4:
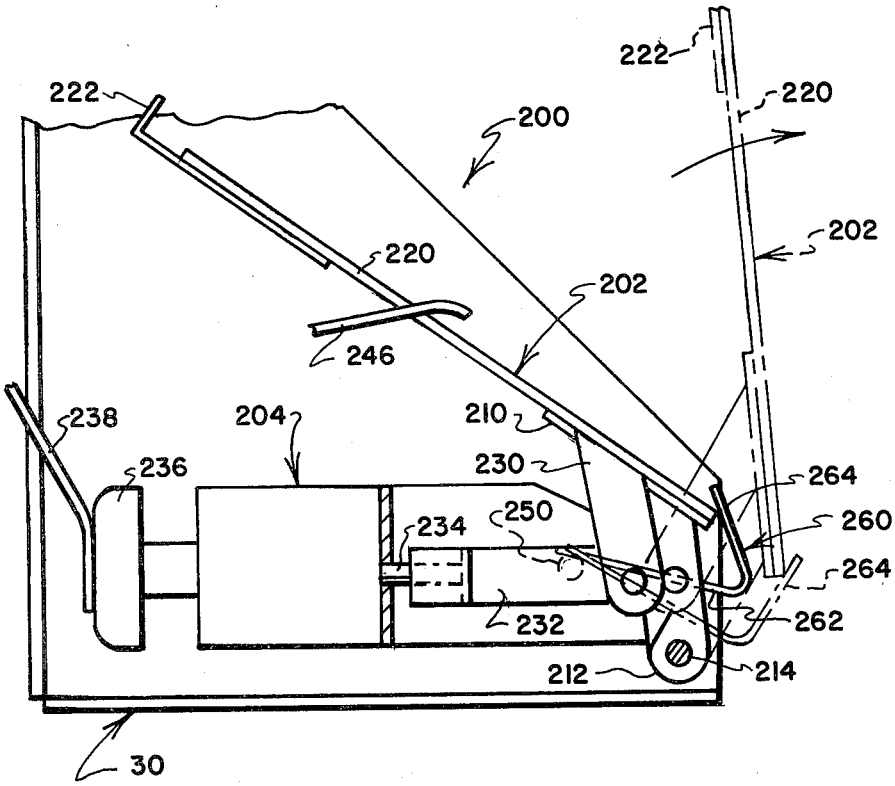
FIG. 4 is a side elevational view, on an enlarged scale, of a positioning mechanism employed in the feeder of FIG. 1, with components of the positioning mechanism being shown in solid lines in their receiving position, and being shown in phantom at a location during movement toward their delivery position.

The positioning mechanism 200 includes one additional assembly which cooperates with the platform 202 to assist in positioning an envelope 16 thereon, and which biases the platform 202 toward its receiving position. Referring to FIGS. 4 and 5, a crankshaft 250 has its opposite ends journaled by the housing 30. A central portion 252 of the crankshaft 250 is offset with respect to the crankshaft's end portions, and is coupled to one end of a tension spring 254. The spring's other end (not shown) is connected to the housing 30, whereby the spring 254 serves to bias the shaft 250 in a direction indicated by an arrow 258 in FIG. 5.

Figure 9:
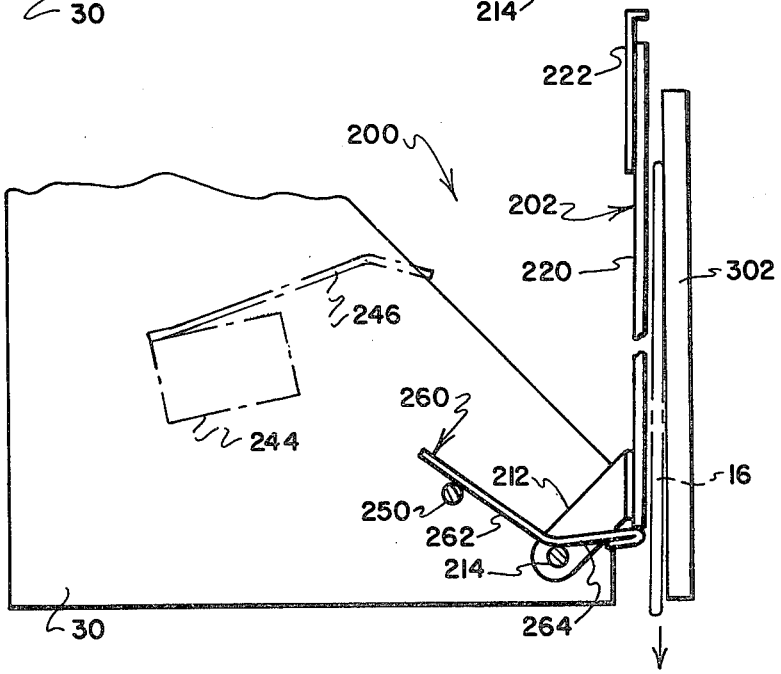

A pair of hook-shaped feet 260 are welded to the aligned end portions of the crankshaft 250. As is best seen in FIG. 7, the feet 260 have forwardly extending portions 262 and upwardly turned portions 264. The upwardly turned portions 264 extend below and forwardly of the platform 202 and serve as stops to receive the lower edge of an envelope 16 as the envelope 16 drops onto the platform 202. As is best seen in FIGS. 8 and 9, when the platform 202 pivots forwardly toward its delivery position, the feet 260 pivot downwardly, and the upwardly extending portions 264 gradually retract relative to the platform 202. When the platform 202 is in its delivery position, the feet 260 no longer stand as obstacles to downward movement of the envelope 16, whereby the envelope 16 can be fed downwardly by the belts 306 when the lugs 304 engage the upper edge of the envelope 16.

The feet 260 not only serve as retractable stops for positioning an envelope 16 on the platform 202, but also engage the bottom surface of the platform 202 and bias the platform 202 toward its receiving position. Once the solenoid 204 is de-energized after having moved the platform 202 to its delivery position, the crankshaft-carried feet 260, operating under the influence of the spring 254, will rapidly return the platform 202 to its receiving position.

Referring to FIG. 3, the transport mechanism 300 includes an upstanding frame 310 which journals the platen roll 14 as well as an upper shaft 312 and an intermediate shaft 314. The frame 310 also carries the resilient panel 302 on its rear face, as is best seen in FIG. 2. Timing belt pulleys 318, 320 are rigidly connected to the platen roll 14 and to the upper shaft 312, and the transport belts 306 are reeved tightly around the pulleys 318, 320. Referring to FIG. 5, the transport belts 306 have conventionally configured drive teeth 308 which engage the toothed timing belt pulleys 318, 320 to assure that the belts 306 travel in unison. The envelope feeding lugs 304 have forward edges which are inclined and cooperate with the outer surfaces of the belts 306 to define V-shaped recesses or pockets 309 which receive and securely engage the trailing edges of envelopes 16 held by the positioning platform 202. The belts 306 each carry five of the lugs 304 at equally spaced intervals along their lengths so that several envelopes 16 can be moved concurrently along various portions of the travel path defined by the belts 306.

Timing belt pulleys 322, 324 are rigidly connected to the upper and intermediate shafts 312, 314, and a drive belt 326 is reeved around the pulleys 322, 324 to drivingly couple the shafts 312, 314. A cam 330 is carried on the intermediate shaft 314. An operating arm 338 of an electrical switch 340 engages the cam 330 and operates the switch 340 in response to rotation of the cam 330. The relative sizes of the pulleys 322, 324 are selected such that the cam 330 makes one rotation each time the transport belts 306 deliver a new envelope 16 to the printing station of the printer 12. The cam 330 is configured so as to cause the switch 340 to close a first electrical circuit during one portion of the cam's rotation, and to close a second electrical circuit during the remainder of the cam's rotation, as will be explained in conjunction with FIG. 6.

The platen roll 14 differs from the platen roll normally used in the printer 12 only in that a portion of its printing surface is removed to make a place for the pulleys 318 and to make room for portions of the frame 310 which journal the platen roll 14. End portions of the platen roll 14 are configured to engage in the conventional manner with other conventional parts of the printer 12. Such drive gears or other components as may normally be carried by the printer's platen are included on the platen roll 14 so that the platen roll 14 may be rotated by the printer's drive system in the same manner as the printer's normal platen roll.

Referring to FIG. 2, once an envelope 16 has been addressed while in the printing station of the printer 12, the belts 306 transport the envelope 16 upwardly along a pair of guides 402. A pair of guides 404 assist in discharging the envelope 16 through the housing opening 32 into the receiving hopper 400. The hopper 400 is formed quite simply from lightweight members which define an upwardly opening chamber 410 for collecting addressed envelopes 16.

Referring to FIG. 6, an electrical circuit for operating the feeder 10 is indicated generally by the numeral 500. The circuit 500 includes a pair of leads 502, 504 which are adapted for connection to a source of alternating current (not shown). The lead 502 is a ground lead which is connected directly to one terminal of the feed motor 124 and to one terminal of the solenoid 204. The lead 504 connects with one terminal of an off-on control switch 506. A lead 508 connects with the other terminal of the switch 506 and with the cam-operated switch 340.

The cam-operated switch 340 serves to electrically connect the lead 508 with either a lead 510 or with a lead 512, as controlled by the position of the cam 330. When the switch 340 connects the leads 508, 510, power is supplied through the lead 510 to energize the solenoid 204. When the switch 340 connects the leads 508, 512, power is supplied through the lead 512 to the sensing switch 244. When the sensing switch 244 is closed, the supply of power continues through a lead 514 to the solenoid-operated switch 240. When the switch 240 is closed, the supply of power continues through a lead 516 to the feed motor 124.

The operation of the circuit 500 may be summarized as follows. The cam-operated switch 340 tends to power either the solenoid 204 or the feed motor 124. The switches 240, 244 serve to prohibit operation of the feed motor 124 until conditions permit and require its operation, namely when the platform 202 is in its receiving position (as sensed by the solenoid-operated switch 240) and when there is no envelope 16 on the platform 202 (as sensed by the switch 244). The cam 330 is configured to operate the switch 340 such that the solenoid 204 is energized only when the transport belts 306 are properly positioned to receive an envelope 16, and to hold the platform 202 in its delivery position until the belts 306 have begun feeding an envelope 16 downwardly from the platform 202. The cam 330 is configured to operate the switch 340 to energize the feed motor circuit at all other times, but the feed motor 124 is not energized until permitted to do so by the switches 240, 244.

As will be apparent from the foregoing description, the feeder 10 utilizes the dispensing, positioning and transport mechanisms 100, 200, 300 to provide a highly reliable means for positively feeding pieces of stationery such as envelopes 16 around the platen roll 14 of a conventional printer 12 to assure proper serial positioning of the pieces of stationery in the printing station of the printer 12. The entire cycle of operation of the feeder 10 is controlled by the rotation of the platen roll 14, whereby no electrical interconnection with the printer 12 is required. Accordingly, as the printer 12 becomes ready to receive another envelope 16, the feeder belts 306 are in the process of bringing it to the printing station of the printer 12 while simultaneously transporting the previously printed envelope 16 to the storage chamber 410.

The system of the present invention can be viewed as providing a particularly desirable, demand-type feeding method. As has been explained previously, the cam-operated switch 340 is controlled by the movement of the transport belts 306 and by the rotation of the platen roll 14, whereby the switch 340 serves to sense both when the printer 12 is ready to receive a piece of stationary such as an envelope 16 from the transport mechanism 300, and when the transport mechanism 300 is ready to receive a piece of stationery such as an envelope 16 from the positioning mechanism 200. Similarly, the switches 240, 244 sense when the positioning mechanism 200 is ready to receive a piece of stationery such as an envelope 16 from the dispensing mechanism 100. With these facts as background, it will be appreciated that the system of the present invention provides a method of feeding whereby:

(1) The dispensing mechanism 100 is operated to dispense a piece of stationery such as an envelope 16 to the positioning mechanism 200 when the positioning mechanism 200 is ready to receive a piece of stationery such as an envelope 16;

(2) The positioning mechanism 200 is operated to position a piece of stationery such as an envelope 16 in the delivery position whenever the transport mechanism 300 is ready to receive a piece of stationery such as an envelope 16; and (3) The transport mechanism 300 is operated to deliver a piece of stationery such as an envelope 16 to the printer 12 whenever the printer 12 is ready to receive a piece of stationery such as an envelope 16.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A stationery feeder for serially transporting discrete pieces of stationery such as envelopes to and from the printing station on a platen-roll-type printer comprising:

(a) a transport mechanism including:

(i) platen roll means for replacing a platen roll normally used by a printer;

(ii) transport belt means reeved around the platen roll means and defining a path of travel along which pieces of stationery may be serially fed to and from a printing station defined by the printer;

(iii) formation means carried on the transport belt means for engaging the trailing edges of pieces of stationery and for pushing the pieces of stationery along the travel path to and from the printing station;

(b) a positioning mechanism including:

(i) platform means movable between a receiving position for receiving thereon in substantially unconfined supported relation one face of a piece of stationery to be fed to the printer, said platform means supporting the piece of stationery by engaging with one face thereof and configured to provide a substantially unobstructed face of said stationery opposite from said supported face adjacent said platform means, and a delivery position wherein said platform means positions said piece of stationery in substantially planar relation in said travel path with said unobstructed stationery face confronting said transport belt means for engagement by the formation means;

(ii) foot means cooperatively associated with said platform means to engage an edge of a piece of stationery delivered to said platform means when said platform means is in said receiving position to retain the stationery piece thereon, and to be retracted from proximity to said platform means when said platform means is in said delivery position thereby to permit ready removal of the stationery piece from the platform means by said transport belt means;

(iii) first power-operated means for moving the platform means between its receiving and delivery positions; and (c) a dispensing mechanism including:

(i) feeding means for dispensing pieces of stationery one at a time to the platform means; and (ii) second power-operated means for selectively operating the feeding means.

2. The stationery feeder of claim 1 wherein the transport belt means is moved along the travel path by rotation of the platen roll means, and the platen roll means is configured to be rotated by the printer in the same manner as is the platen roll normally used by the printer.

3. The stationery feeder of claim 2 wherein the transport belt means includes a series of spaced formation means along its length for simultaneously serially feeding a plurality of discrete pieces of stationery along the travel path.

4. The stationery feeder of claim 3 additionally including control means for coordinating the operation of the first and second power-operated means for:

(a) actuating the second power-operated means to effect feeding of a piece of stationery onto the platform means when the platform means is in its receiving position and has no piece of stationery thereon; and (b) actuating the first power-operated means to position a piece of stationery along the travel path when the transport belt means is ready to receive a piece of stationery to effect serial feeding of pieces of stationery to the printing station.

5. The stationery feeder of claim 1 wherein the transport belt means includes a pair of endless transport belts extending side-by-side in spaced relationship, and wherein the formation means includes lug-type projections formed on the transport belts.

6. The stationery feeder of claim 5 wherein each of the transport belts has a plurality of lug-type projections formed thereon at substantially equally spaced distances along the lengths of the belts.

7. The stationery feeder of claim 6 wherein each of the lug-type projections cooperates with its associated belt to define a recess for securely receiving portions of the trailing edges of pieces of stationery to be fed along the travel path.

8. The stationery feeder of claim 1 wherein the transport mechanism additionally includes guide means extending along the travel path for guiding pieces of stationery therealong during feeding to and from the printing station.

9. The stationery feeder of claim 8 wherein the guide means includes a U-shaped paper guide configured to underlie the platen roll means and to assist pieces of stationery in feeding around the platen roll means.

10. The stationery feeder of claim 8 wherein:

(a) the feeder additionally includes structure defining a storage chamber for receiving printed pieces of stationery; and (b) the guide means includes structure extending along the travel path for guiding pieces of stationery from the printing station to the storage chamber.

11. The stationery feeder of claim 1 wherein said foot means includes means for progressively retracting said foot means as said first power-operated means move said platform means between its receiving and delivery positions.

12. The stationery feeder of claim 11 additionally including biasing means for biasing the foot means into engagement with portions of the platform means, and for biasing the platform means toward its receiving position by virtue of the engagement of the biased foot means with portions of the platform means.

13. The stationery feeder of claim 1 wherein the platform means includes a plurality of side-by-side finger-like members extending upwardly from a mounting bar, and wherein at least two of the finger-like members carry hook-shaped end means near their upper ends for engaging a piece of stationery in the form of an envelope positioned on the platform means and assisting in properly positioning the envelope for engagement by the transport belt means as the platform means moves to its delivery position.

14. The stationery feeder of claim 1 additionally including housing means for enclosing portions of and for supporting the transport, positioning and dispensing mechanisms.

15. The stationery feeder of claim 14 wherein the platform means is pivotally connected to the housing means for movement between its receiving and delivery positions.

16. The stationery feeder of claim 14 wherein the transport mechanism includes a frame which journals the platen roll means and which connects with the housing means for imposing at least a portion of weight of the housing means on the platen roll means for support.

17. The stationery feeder of claim 1 wherein:

(a) the dispensing mechanism includes a structure defining an upstanding supply chamber configured to receive a stack of pieces of stationery to be fed serially to the printer;

(b) the feeding means includes a feed roll extending across the bottom end region of the supply chamber, the feed roll being positioned to engage the lowermost piece of stationery in the stack and to support a portion of the weight of the stack; and (c) a relatively small tab-like projection is connected to the structure which defines the supply chamber and extends into the supply chamber at a position spaced from but located approximately midway along the length of the feed roll to assist the feed roll in supporting the stack of pieces of stationary.

18. A stationery feeder for serially transporting discrete pieces of stationery to and from a printer, comprising:

(a) a dispensing mechanism including:

(i) structure defining a supply chamber for receiving and holding a stack of stationery pieces to be fed serially to a printer;

(ii) feeding means for dispensing pieces of stationery one at a time from the stack;

(b) a positioning mechanism including structure having a substantially planar surface and cooperating foot means having first and second locations relative to said surface, said positioning mechanism being mounted for movement between a receiving position wherein the positioning mechanism is positioned to receive on said planar surface thereof a piece of stationery dispensed by the feeding means with an edge of said stationery engaged with said foot means in its said first location to retain the stationery in supported relation on said surface, and a delivery position wherein said piece of stationery is oriented in a predetermined plane with said foot means substantially retracted to its said second location with respect to said planar surface to permit removal of said stationery from said surface;

(c) a transport mechanism including:

(i) transport belt means and structure supporting the belt means for defining a path of travel for the belt means which extends along said plane and toward the printer;

(ii) formation means carried on the belt means for engaging an edge of said piece of stationery in passing along said plane; and, (d) control means for:

(i) operating the feeding means to dispense a piece of stationery to the positioning mechanism only when:

(a) the positioning mechanism structure is in its receiving position; and when (b) there is no piece of stationery already received by the positioning mechanism structure;

(ii) moving the positioning mechanism structure to its delivery position only when the formation means on the transport belt means is approaching the delivery position and is therefore ready to receive a piece of stationery; and (iii) retaining the positioning mechanism structure in its delivery position until the formation means has engaged an edge of said piece of stationery and has begun feeding said piece of stationery along said travel path.

19. The stationery feeder of claim 18 wherein the control means includes:

(a) sensing means for sensing a first condition when the positioning mechanism structure is out of its receiving position, and for sensing a second condition when no piece of stationery is received by the positioning mechanism structure; and (b) disabling means responsive to the sensing means sensing of either of the first or second conditions to prevent operation of the feeding means when either of the first or second conditions is sensed.

20. The stationery feeder of claim 19 wherein the transport belt means includes a series of spaced formation means along the length thereof for simultaneously serially feeding a plurality of discrete pieces of stationery along the travel path.

21. The stationery feeder of claim 19 wherein the transport belt means includes a pair of endless transport belts extending side-by-side in spaced relationship, and wherein the formation means includes lug-type projections formed on the transport belts.

22. The stationery feeder of claim 21 wherein each of the transport belts has a plurality of lug-type projections formed thereon at substantially equally spaced distances along the lengths of the belts.

23. The stationery feeder of claim 18 additionally including biasing means for biasing said foot means into engagement with portions of said planar surface, and for biasing said planar surface toward its receiving position by virtue of the engagement of the biased foot means with portions of said planar surface.

24. The stationery feeder of claim 18 wherein the planar surface means includes a plurality of side-by-side finger-like members extending upwardly from a mounting bar, and wherein at least two of the finger-like members carry hook-shaped end means near their upper ends for engaging a piece of stationery positioned on the said planar surface and assisting in properly positioning the stationery for engagement by the transport belt means as said planar surface moves to its said delivery position.

25. A method of feeding discrete pieces of stationery to a printer, comprising the steps of:

(a) providing structure defining a supply station at a location removed from the printer;

(b) providing dispensing means for serially dispensing discrete pieces of stationery in a predetermined direction from the supply station;

(c) providing positioning means for receiving pieces of stationery dispensed by the dispensing means and supporting the pieces on one face thereof in substantially planar relation with the other face of said pieces substantially unobstructed, and providing means engaging one edge of said pieces while supported to preclude unwanted movement in said predetermined direction from supported relation, and for serially moving said pieces in said supported planar relation from the position in which said pieces were received and supported to a predetermined position in a delivery station to dispose said unobstructed face of the stationery in position for removal, and providing means withdrawing said edge engaging means thereat to permit removal of the pieces;

(d) providing transport means including at least one transport belt extending alongside the delivery station for receiving and removing pieces of stationery positioned in the delivery station and for transporting such pieces of stationery of the printer;

(e) providing sensing means for:

(i) sensing when the positioning means is ready to receive a piece of stationery;

(ii) sensing when the transport means is ready to receive a piece of stationery;

(iii) sensing when the printer is ready to receive a piece of stationery;

(f) presenting pieces of stationery to the supply station;

(g) operating the dispensing means to dispense a piece of stationery to the positioning means wherever the positioning means is ready to receive a piece of stationery;

(h) operating the positioning means to position a piece of stationery in the delivery station whenever the transport means is ready to receive a piece of stationery; and (i) operating the transport means to feed a piece of stationery to the printer whenever the printer is ready to receive a piece of stationery.

26. The method of claim 25 wherein the step of providing a positioning means includes the step of providing pivotally mounted platform means movable between receiving and delivery positions, and the step of operating the positioning means includes the step of pivoting the platform means from the receiving position to the delivery position.

27. The method of claim 26 wherein the step of operating the positioning means includes the step of maintaining the platform means in its delivery position until the transport means has begun feeding a piece of stationery from the delivery station.

28. The method of claim 25 wherein the step of providing transport means includes the step of reeving the transport belt around a platen roll of the printer, and the step of operating the transport means includes the step of driving the transport belt by virtue of rotating the platen roll.

* * * * *